US010008769B2

(12) United States Patent
Tian et al.

(10) Patent No.: US 10,008,769 B2
(45) Date of Patent: Jun. 26, 2018

(54) MULTI-ANTENNA TERMINAL

(71) Applicant: ZTE Corporation, Shenzhen (CN)

(72) Inventors: Chao Tian, Shenzhen (CN); Chaofan Shu, Shenzhen (CN); Yang Liu, Shenzhen (CN)

(73) Assignee: ZTE CORPORATION, Shenzhen (CN)

( * ) Notice: Subject to any disclaimer, the term of this patent is extended or adjusted under 35 U.S.C. 154(b) by 0 days. days.

(21) Appl. No.: 15/024,671

(22) PCT Filed: Apr. 23, 2014

(86) PCT No.: PCT/CN2014/076067
§ 371 (c)(1),
(2) Date: Mar. 24, 2016

(87) PCT Pub. No.: WO2014/180256
PCT Pub. Date: Nov. 13, 2014

(65) Prior Publication Data

US 2016/0248154 A1 Aug. 25, 2016

(30) Foreign Application Priority Data

Sep. 25, 2013 (CN) ..... 2013 1 0443357

(51) Int. Cl.
*H01Q 1/38* (2006.01)
*H01Q 1/52* (2006.01)
(Continued)

(52) U.S. Cl.
CPC ..... *H01Q 1/523* (2013.01); *H01Q 1/243* (2013.01); *H01Q 1/521* (2013.01); *H01Q 9/42* (2013.01);
(Continued)

(58) Field of Classification Search
CPC ..... H01Q 1/523; H01Q 1/243; H01Q 15/0086
(Continued)

(56) References Cited

U.S. PATENT DOCUMENTS 6,133,880 A * 10/2000 Grangeat ..... H01P 5/08 343/700 MS
7,629,930 B2 * 12/2009 Murch ..... H01Q 1/48 343/700 MS
(Continued)

FOREIGN PATENT DOCUMENTS

CN 1941502 A 4/2007
KR 20120061555 A 6/2012

OTHER PUBLICATIONS

International Search Report for corresponding application No. PCT/CN2014/076067 filed on Apr. 23, 2014; dated Jul. 28, 2014.

*Primary Examiner* — Daniel J Munoz
*Assistant Examiner* — Hai Tran
(74) *Attorney, Agent, or Firm* — Cantor Colburn LLP

(57) ABSTRACT

Provided is a multi-antenna terminal. The multi-antenna terminal includes a Printed Circuit Board (PCB), a first antenna, a second antenna, an inductance element, a first split-ring resonator group and a second split-ring resonator group. The first antenna and the second antenna are respectively connected to a grounding wire on the PCB; the first split-ring resonator group and the second split-ring resonator group are arranged between the first antenna and the second antenna; the first split-ring resonator group and the second split-ring resonator group are arranged in parallel, and respectively connected to a grounding wire on the PCB; one end of the inductance element is connected to the first split-ring resonator group, and the other end of the inductance element is connected to the second split-ring resonator group. The multi-antenna terminal can solve the problem that signals between respective antennas on the multi-
(Continued)

antenna terminal interfere with one another in the related art, so that the use by people is more convenient. In addition, the multi-antenna terminal has the advantages of simple structure, lower cost and the like.

7 Claims, 2 Drawing Sheets

(51) Int. Cl.
*H01Q 1/24* (2006.01)
*H01Q 9/42* (2006.01)
*H01Q 15/00* (2006.01)

(52) U.S. Cl.
CPC ..... *H01Q 15/006* (2013.01); *H01Q 15/0086* (2013.01)

(58) Field of Classification Search
USPC ..... 343/700 MS, 848
See application file for complete search history.

(56) References Cited

U.S. PATENT DOCUMENTS

2010/0156745 A1* 6/2010 Andrenko ..... H01Q 1/38 343/848
2011/0148736 A1 6/2011 Choi

* cited by examiner

MULTI-ANTENNA TERMINAL

TECHNICAL FIELD

The present disclosure relates to the technical field of terminals having multiple antennas, in particular to a multi-antenna terminal.

BACKGROUND

A multi-Input Multi-Output (MIMO) or multi-transmitting multi-receiving antenna technology is a major breakthrough of antenna technologies in the field of wireless mobile communications. This technology, which is a key technology that must be adopted by a new-generation mobile communication system, can increase in multiples the capacity and the spectrum efficiency of a communication system under the condition that the bandwidth is not increased. The MIMO technology allows a plurality of antennas to simultaneously transmit and receive a plurality of spatial streams (frequency bands), and can identify signals transmitted to or received from different spatial orientations. By virtue of the application of a multi-antenna system, parallel data streams can be transmitted at the same time. In addition, the adoption of multiple antennas at a transmitting end or a receiving end can obviously overcome channel fading and reduce an error rate.

However, terminal equipment, particularly a handheld terminal, is limited by the appearance and the size of the product, so it is hard to implement multiple antennas in a terminal product. To solve the technical problem, a conventional method is to set mutual distances between the multiple antennas as far as possible to make the separation degree between every two adjacent antennas large enough; such a layout can achieve a certain effect. However, at present, there has been higher and higher requirement on the appearance of the terminal products, and the minimization of the products has become an irresistible trend of the future. This trend leads to a result that the distances between the antennas cannot be set ideally, and the interference between the multiple antennas cannot be avoided. A main reason of the interference is that all the antennas are in common ground connection with a Printed Circuit Board (PCB). When two adjacent antennas receive signals, an extremely high coupling current will be formed between feeds of the two antennas, and it leads to mutual interference between the two adjacent antennas.

Thus, how to prevent mutual interference between multiple antennas when the terminal is small in its physical size has become a problem to be solved in an urgent need at present.

SUMMARY

The embodiments of the present disclosure provide a multi-antenna terminal which aims at enhancing a signal isolation effect between two adjacent antennas, to reduce signal interference between the two adjacent antennas.

A multi-antenna terminal is provided, including a Printed Circuit Board (PCB), a first antenna, a second antenna, an inductance element, a first split-ring resonator group and a second split-ring resonator group. The first antenna and the second antenna are respectively connected to a grounding wire on the PCB; the first split-ring resonator group and the second split-ring resonator group are arranged between the first antenna and the second antenna; the first split-ring resonator group and the second split-ring resonator group are arranged in parallel, and respectively connected to a grounding wire on the PCB; one end of the inductance element is connected to the first split-ring resonator group, and the other end of the inductance element is connected to the second split-ring resonator group.

In an example embodiment, the first split-ring resonator group consists of at least one single split-ring resonator, and the second split-ring resonator group consists of at least one single split-ring resonator.

In an example embodiment, the first split-ring resonator group consists of a plurality of single split-ring resonators which are connected in series, and the second split-ring resonator group consists of a plurality of single split-ring resonators which are connected in series.

In an example embodiment, the single split-ring resonator consists of a plurality of microstrip lines.

In an example embodiment, both the first split-ring resonator group and the second split-ring resonator group are rectangular frames, and one side of each rectangular frame is provided with a recess, and a gap is formed in a bottom of the recess.

In an example embodiment, the inductance element is arranged between the first split-ring resonator group and the second split-ring resonator group.

In an example embodiment, the inductance element is a microstrip line. In an example embodiment, the first antenna and the second antenna are arranged at a same side of the PCB.

According to the multi-antenna terminal provided by the embodiments of the present disclosure, the first split-ring resonator group and the second split-ring resonator group are arranged between the first antenna and the second antenna, and the inductance element connects the first split-ring resonator group with the second split-ring resonator group to form an LC resonance circuit. In this way, the first antenna and the second antenna can be effectively signal-isolated, and the degree of mutual interference on signals between two adjacent antennas is lowered.

The implementation of the idea, the functional characteristics and the advantages of the present disclosure are further described with the embodiments and the accompanying drawings.

DETAILED DESCRIPTION OF THE EMBODIMENTS

It should be known that the specific embodiments described here are to explain the present disclosure only, and not intended to limit the present disclosure.

Figure 1:
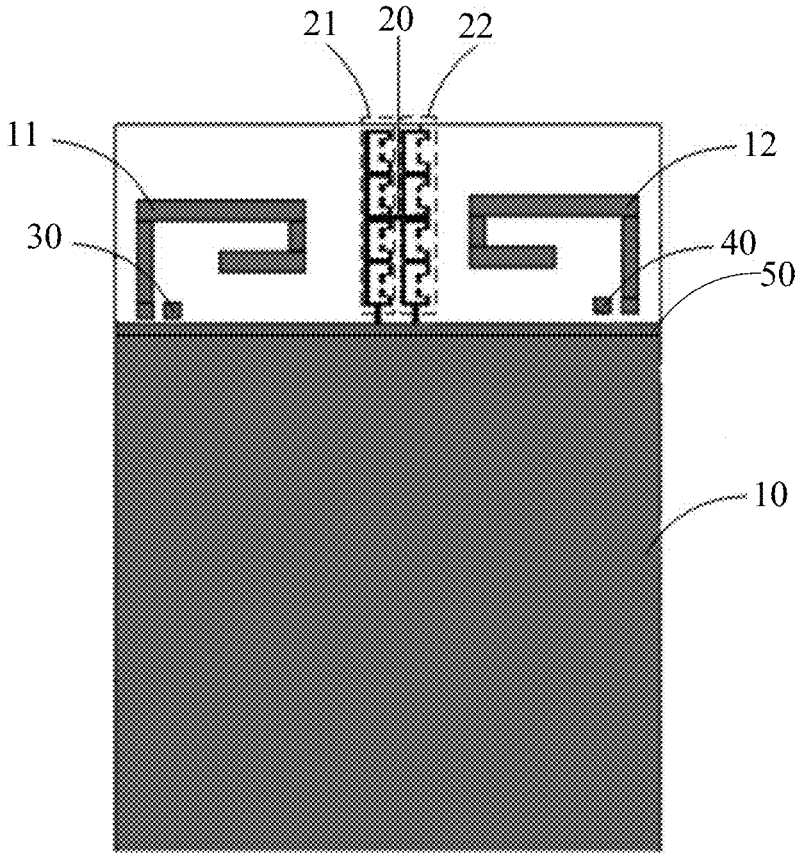
FIG. 1 is a structure diagram of a multi-antenna terminal according to an example embodiment of the present disclosure.
Figure 2:
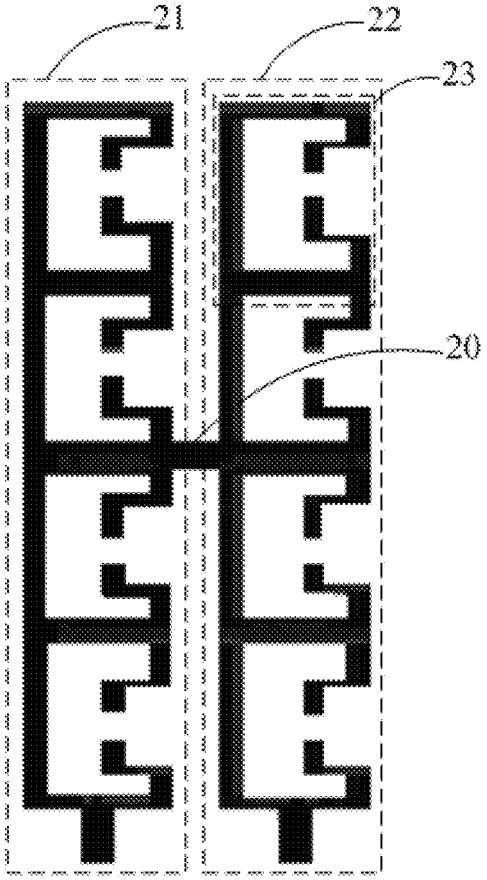
FIG. 2 is an enlarged drawing of a portion of FIG. 1.

With reference to FIG. 1 and FIG. 2, FIG. 1 is a structure diagram of a multi-antenna terminal according to an example embodiment of the present disclosure; FIG. 2 is an enlarged drawing of a portion of FIG. 1.

The embodiment provides a multi-antenna terminal, including a Printed Circuit Board (PCB) 10, a first antenna 11, a second antenna 12, an inductance element 20, a first split-ring resonator group 21 and a second split-ring resonator group 22, wherein: the first antenna 11 and the second antenna 12 are respectively connected to a grounding wire 50 on the PCB 10; the first split-ring resonator group 21 and the second split-ring resonator group 22 are arranged between the first antenna 11 and the second antenna 12; the first split-ring resonator group 21 and the second split-ring resonator group 22 are arranged in parallel, and respectively connected to a grounding wire 50 on the PCB 10; one end of the inductance element 20 is connected to the first split-ring resonator group 21, and the other end of the inductance element is connected to the second split-ring resonator group 22. As the inductance element 20 connects the first split-ring resonator group 21 and the second split-ring resonator group 22 together, the first split-ring resonator group 21, the second split-ring resonator group 22 and the inductance element 20 form a parallel-connected LC resonance circuit; since the parallel-connected LC resonance circuit is equivalent to an open circuit in the resonance, a coupling signal between the first antenna 11 and the second antenna 12 can be effectively isolated, and mutual interference between the first antenna 11 and the second antenna 12 can be prevented.

In the embodiment, the first split-ring resonator group 21 and the second split-ring resonator group 22 may be circular split-ring resonators, rectangular split-ring resonators or other split-ring resonators with proper shapes. In this embodiment, the inductance element 20 may be an inductor, a coil, a micro strip line or any other applicable inductance element. In the embodiment, the inductance element 20 is preferably a micro strip line, as the microstrip line has the advantages of small size, light weight, wide available frequency band, high reliability and the like.

To better describe the idea of the embodiment of the present disclosure, the embodiment is described below in detail with FIG. 1. With respect to FIG. 1, FIG. 1 is a structure diagram of a multi-antenna terminal according to an example embodiment of the present disclosure. FIG. 1 takes the first antenna 11 and the second antenna 12 as examples, wherein the first antenna 11 and the second antenna 12 are respectively arranged at a same side of the PCB 10, and share a grounding wire 50 of the PCB 10. If no isolation measures are taken, extremely high coupling current may be generated between a first feed 30 (a power output of the first antenna 11) and a second feed 40 (a power output of the second antenna 12), and this causes a very serious mutual signal interference between the first antenna 11 and the second antenna 12. While according to this embodiment, the first split-ring resonator group 21 and the second split-ring resonator group 22 which are connected to each other are arranged between the first antenna 11 and the second antenna 12, and the first split-ring resonator group 21 and the second split-ring resonator group 22 are simultaneously connected to a grounding line on the PCB 10, that is, a parallel-connected LC resonance circuit which can resonate on a certain resonance point is formed between the first antenna 11 and the second antenna 12, and this LC resonance circuit is equivalent to an open circuit between the first antenna 11 and the second antenna 12 during resonance; therefore, mutual coupling between the first antenna 11 and the second antenna 12 is effectively reduced, and the mutual signal interference between the first antenna 11 and the second antenna 12 is effectively prevented.

A person skilled in the art should know that: each of the first split-ring resonator group 21 and the second split-ring resonator group 22 may either consist of a single split-ring resonator 23, or consist of a plurality of split-ring resonators 23 which are connected in series (such as the first split-ring resonator group 21 and the second split-ring resonator group 22 which are as shown in FIG. 1 and FIG. 2). The first split-ring resonator group 21 and the second split-ring resonator group 22 which consist of a plurality of single split-ring resonators 23 are taken as examples, and it should be understood that the number of the single split-ring resonators 23 forming the first split-ring resonator group 21 and the second split-ring resonator group 22 is specifically determined according to distribution positions of two antennas and antenna size of the two antennas. In addition, the first split-ring resonator group 21 and the second split-ring resonator group 22 are both connected to a grounding wire 50 of the PCB 10, so that the multiple single split-ring resonators 23 forming the first split-ring resonator group 21 and the multiple single split-ring resonators 23 forming the second split-ring resonator group 22 can form a semi-enclosed structure for the first antenna 11 and the second antenna 12, to make the isolation effect better. In addition, the inductance element 20 connects the first split-ring resonator group 21 with the second split-ring resonator group 22, to form an LC resonance circuit. The LC resonance circuit is equivalent to an open circuit between the first antenna 11 and the second antenna 12 when generating resonance with all the antennas, and the position of the inductance element 20 can be adjusted according to resonance frequencies of the antennas. It should be noted that there may be multiple inductance elements 20. In order to reduce the cost and simplify the structure, the inductance elements are arranged between the first split-ring resonator group 21 and the second split-ring resonator group 22.

Thus, although the first antenna 11 and the second antenna 12 are of a co-grounded structure, the mutual interference between the two antennas is greatly reduced by virtue of the adoption of the LC resonance circuit structure for isolation.

In an example embodiment, to enhance the isolation effect between the first antenna 11 and the second antenna 12, the single split-ring resonator 23 may consist of a plurality of microstrip lines. As the microstrip lines have the advantages of wide available frequency band, high reliability and the like, the internal resistance of the LC resonance circuit consisting of the first split-ring resonator group 21 and the second split-ring resonator group 22 is high.

In an example embodiment, to enhance the isolation effect between the first antenna 11 and the second antenna 12, the first split-ring resonator group 21 and the second split-ring resonator group 22 are both rectangular frames, and one side of each rectangular frame is provided with a recess, and a gap is formed in a bottom of the recess. Such a structure forms a wide resonance frequency band and high internal resistance, so that the isolation degree between the first antenna 11 and the second antenna 12 can be increased.

In an example embodiment, to reduce the size of the multi-antenna terminal and facilitate distribution of other elements, the first antenna 11 and the second antenna 12 may be arranged at a same side of the PCB 10. By virtue of the adoption of an isolation technology, the isolation degree between one antenna and another antenna is higher, and even if the antennas are arranged at the same end, no great interference will be generated.

The above is only example embodiments of the present disclosure, and not intended to limit the scope of the patent of the present disclosure. Any equivalent structure or equivalent flow transformation which is executed according to the contents in the specification and the drawings of the present disclosure, and either directly or indirectly applied to other relevant technical fields falls within the scope of protection of the patent of the present disclosure.

INDUSTRIAL APPLICABILITY

The technical solution provided by the embodiments of the present disclosure can be applied to the technical field of multi-antenna terminals, to solve the problem that signals between all antennas on a multi-antenna terminal interfere with one another in the related art, so that the use by people is more convenient; in addition, the embodiments of the present disclosure have advantages of simple structure, lower cost and the like.

What is claimed is:

1. A multi-antenna terminal, comprising: a Printed Circuit Board (PCB), a first antenna and a second antenna, wherein the first antenna and the second antenna are respectively connected to a grounding wire on the PCB; further comprising at least one inductance element, a first split-ring resonator group and a second split-ring resonator group, wherein the first split-ring resonator group and the second split-ring resonator group are arranged between the first antenna and the second antenna, the first split-ring resonator group and the second split-ring resonator group are arranged in parallel, and respectively connected to the grounding wire on the PCB, both the first split-ring resonator group and the second split-ring resonator group are rectangular frames, and one side of each rectangular frame is provided with a recess, and a gap is formed in a bottom of the recess, one end of the inductance element is connected to the first split-ring resonator group, and the other end of the inductance element is connected to the second split-ring resonator group.

2. The multi-antenna terminal as claimed in claim 1, wherein the first split-ring resonator group consists of at least one single split-ring resonator, and the second split-ring resonator group consists of at least one single split-ring resonator.

3. The multi-antenna terminal as claimed in claim 2, wherein the first split-ring resonator group consists of a plurality of single split-ring resonators which are connected in series, and the second split-ring resonator group consists of a plurality of single split-ring resonators which are connected in series.

4. The multi-antenna terminal as claimed in claim 3, wherein the single split-ring resonator consists of a plurality of microstrip lines.

5. The multi-antenna terminal as claimed in claim 1, wherein the inductance element is arranged between the first split-ring resonator group and the second split-ring resonator group.

6. The multi-antenna terminal as claimed in claim 5, wherein the inductance element is a micro strip line.

7. The multi-antenna terminal as claimed in claim 1, wherein the first antenna and the second antenna are arranged at a same side of the PCB.

* * * * *